US006824746B2

(12) United States Patent
Ayukawa et al.

(10) Patent No.: US 6,824,746 B2
(45) Date of Patent: Nov. 30, 2004

(54) HIGH-ENERGY BEAM IRRADIATING DESULFURIZATION DEVICE

(75) Inventors: Yasuhiro Ayukawa, Osaka (JP); Megumi Ono, Osaka (JP)

(73) Assignee: Rigaku Industrial Corporation, Osaka (JP)

( * ) Notice: Subject to any disclaimer, the term of this patent is extended or adjusted under 35 U.S.C. 154(b) by 284 days.

(21) Appl. No.: 10/138,322

(22) Filed: May 6, 2002

(65) Prior Publication Data

US 2003/0017091 A1 Jan. 23, 2003

(30) Foreign Application Priority Data

May 11, 2001 (JP) ..... 2001-142468

(51) Int. Cl.[7] ..... B01J 19/08; B01J 19/12

(52) U.S. Cl. ..... 422/186.3; 422/186; 422/186.04

(58) Field of Search ..... 422/186, 186.04, 422/186.3

(56) References Cited

U.S. PATENT DOCUMENTS

| | | | | | |
|---|---|---|---|---|---|
| 3,616,375 | A | * | 10/1971 | Inoue | 204/157.61 |
| 4,347,226 | A | * | 8/1982 | Audeh et al. | 588/216 |
| 5,284,717 | A | * | 2/1994 | Yamase et al. | 429/17 |
| 5,458,752 | A | * | 10/1995 | Lizama et al. | 204/164 |
| 6,093,288 | A | * | 7/2000 | Izutsu et al. | 204/157.3 |
| 2001/0025781 | A1 | * | 10/2001 | Linkous et al. | 204/157.4 |

* cited by examiner

*Primary Examiner*—Steven VerSteeg
(74) *Attorney, Agent, or Firm*—Wenderoth, Lind & Ponack, L.L.P.

(57) ABSTRACT

The present invention is to provide an efficient and highly practical novel desulfurization device capable of executing the depth desulfurization. A high-energy beam irradiating desulfurization device for a petroleum product or a petroleum semimanufactured product, comprising a catalyst liquid-liquid contact part for contacting a metal compound solution as a catalyst and the petroleum product or the petroleum semimanufactured product, a high-energy beam irradiating part, and a sulfide collecting part for separating and collecting sulfide of the metal produced by the high-energy beam irradiation, is provided.

69 Claims, 3 Drawing Sheets

COMPARISON OF THE LIQUID CATALYST AND THE SOLID CATALYST

HIGH-ENERGY BEAM IRRADIATING DESULFURIZATION DEVICE

BACKGROUND OF THE INVENTION

1. Field of the Invention

The present invention relates to a high-energy beam irradiating desulfurization device. More specifically, the present invention relates to a novel desulfurization device by high-energy beam irradiation, capable of executing depth desulfurization of a sulfur content contained in a petroleum product or a petroleum semimanufactured product highly efficiently.

2. Description of the Related Art

Conventionally, in a process of petroleum refinement, a desulfurization device plays an important role as the device for eliminating the sulfur content. As a method commonly used in the present desulfurization process, a desulfurization method of adding hydrogen and converting the S content to hydrogen sulfide under high temperature and high pressure, a method of extracting and eliminating the sulfur content using ADIP (diisopropanolamine) or MEAH (monoethanol amine), or the like, are known.

The S contained in light oil, middle oil, or the like in a petroleum product or a petroleum semimanufactured product exists in various forms. Representative forms thereof include $H_2S$, R—SH, R—S—S—R, thiophene, benzothiophene, dibenzothiophene, or the like. Depending on the boiling point fraction of the oil, the form of the contained S therein differs as well.

Among the S contents existing in the various forms, according to the above-mentioned conventional common methods, the $H_2S$ (hydrogen sulfide) and R—SH (mercaptan) can be eliminated relatively easily.

However, as to the thiophene acid represented by the following formula, it is not easy to eliminate the same by the conventional methods. In particular, the depth desulfurization of the sulfur (S) content capable of eliminating the 4,6-dialkyl dibenzothiophene in light oil has been extremely difficult.

[Chemical formula 1]

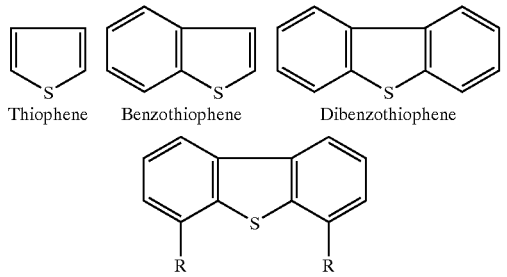

In contrast, since a problem is involved in that the catalyst for the hydrogenation is mixed in the petroleum in the above-mentioned conventional hydrogen desulfurization method, as a countermeasure for solving the problem, a desulfurization method by directing a radioactive ray to oil for activating the S content in the oil, and contacting the same with metal so as to be eliminated as metal sulfide has been proposed (official gazette of Japanese Patent Application Laid-Open No. 50-39703). According to the method, a radioactive ray is directed with solid powder of metal such as copper dispersed in the oil so that the metal sulfide is separated as a solid content from the oil.

However, the method of directing the radioactive ray has been only proposed without actual use in practice. As the reason therefor, use of metal powder, which can hardly be dispersed well in the oil and absence of discussion for the actual condition of the petroleum refinement process and the device embodiment, can be presented. Furthermore, in the proposed method, the above-mentioned problem recognition in the depth desulfurization is not found.

In view of the above-mentioned conventional technique, the present inventor has aimed at providing an efficient and highly practical novel desulfurization device capable of executing the depth desulfurization, which has been at issue recently as the object of the invention.

SUMMARY OF THE INVENTION

In order to solve the above-mentioned problems, according to the first aspect of the present invention, there is provided a high-energy beam irradiating desulfurization device for a petroleum product or a petroleum semimanufactured product, comprising a catalyst liquid-liquid contact part for contacting a metal compound solution as a catalyst and the petroleum product or the petroleum semimanufactured product, a high-energy beam irradiating part, and a sulfide collecting part for separating and collecting sulfide of the metal produced by the high-energy beam irradiation, is provided.

Moreover, the second aspect of the present invention provides a high-energy beam irradiation desulfurization device according to the first aspect, wherein the metal compound is at least one selected from the group consisting of a hydrophilic compound and a lipophilic compound. The third aspect provides a high-energy beam irradiating desulfurization device, wherein the metal compound solution is a solution of at least one selected from the group consisting of water and an organic solvent. The fourth aspect provides a high-energy beam irradiating desulfurization device, wherein the metal comprising the metal compound is at least one selected from the group consisting of silver, lead, iron, copper, and precious metal.

Furthermore, the fifth aspect provides a high-energy beam irradiating desulfurization device according to any one of the above-mentioned aspect, wherein the high-energy beam irradiating part is provided with at least one selected from the group consisting of an X ray source, a radioactive ray source, a synchrotron, and a microwave source. The sixth aspect provides a high-energy beam irradiating desulfurization device according to any one of the above-mentioned aspect, wherein the high-energy beam is directed to a liquid mixture from the catalyst liquid-liquid contacting part at least either from above or sideways in the high-energy beam irradiating part. The seventh aspect provides a high-energy beam irradiating desulfurization device according to any one of the above-mentioned aspect, wherein the sulfide collecting part is provided with at least one selected from the group consisting of a filter, a static amount separator, a centrifugal separating device, and a cyclone separating device.

Moreover, the eighth aspect provides a high-energy beam irradiating desulfurization device according to any one of the above-mentioned aspect, wherein a secondary high-energy beam irradiating part is provided for secondarily irradiating a high-energy beam from at least either above or sideways for eliminating the residual catalyst subsequent to the sulfide collecting part. The ninth aspect provides a high-energy beam irradiating desulfurization device according to any one of the above-mentioned aspect, wherein a catalyst reproducing part is provided for reproducing the catalyst from the sulfide of the metal collected in the sulfide collecting part. The tenth aspect provides a high-energy beam irradiating desulfurization device according to any one of the above-mentioned aspect, wherein a sulfuric acid producing part is provided for producing sulfuric acid from the sulfide of the metal collected in the sulfide collecting part.

Furthermore, the eleventh aspect of the present invention provides a high-energy beam irradiating desulfurization device according to the ninth aspect, wherein a circulating path to the catalyst liquid-liquid contacting part is provided for the reproduced catalyst. The twelfth aspect provides a high-energy beam irradiating desulfurization device, wherein a distillation part is provided for separating the desulfurized petroleum product or petroleum semimanufactured product and the catalyst solvent. Furthermore, the thirteenth aspect provides a petroleum refining device comprising any one of the above-mentioned desulfurization devices assembled as a part of the petroleum refining device.

The above-mentioned present invention is similar to the above-mentioned methods already proposed in that the desulfurization is executed by irradiating a high-energy beam. However, it is essentially different in terms of the technological concept of the desulfurization concerning all of the object of the invention, the configuration, and the operation effect. In particular, in the present invention, the depth desulfurization of the S content capable of eliminating the 4,6-dibenzothiophene in the light oil, which has conventionally been extremely difficult, can be carried out by irradiation of the high-energy beam. At the same time, a highly practical desulfurization device having the excellent efficiency can be provided.

DETAILED DESCRIPTION OF THE INVENTION

Figure 1:
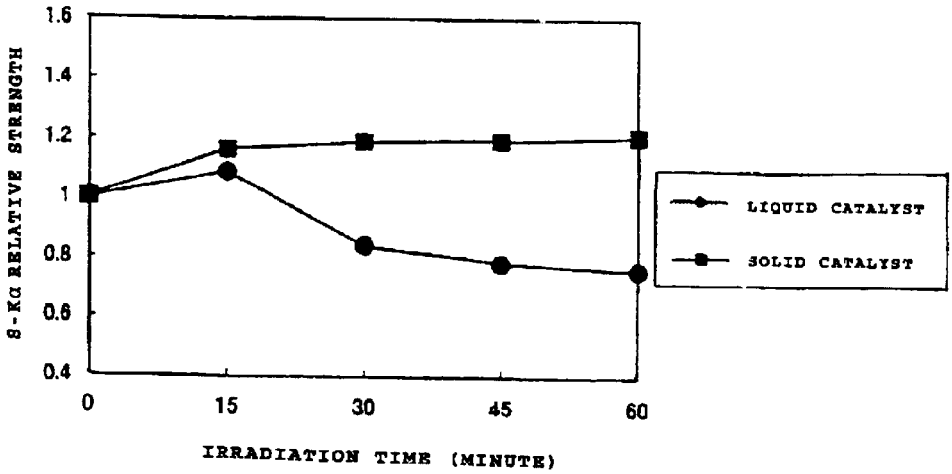
FIG. 1 is a graph showing the result of a test example 1.

The present invention has the above-mentioned characteristics. Hereinafter, embodiments thereof will be explained.

A desulfurization device according to the present invention comprises:

<A> a catalyst liquid-liquid contacting part for contacting a metal compound solution as a catalyst and the petroleum product or the petroleum semimanufactured product, <B> a high-energy beam irradiating part, and <C> a sulfide collecting part for separating and collecting sulfide of the metal produced by the high-energy beam irradiation, as in the above-mentioned first aspect as the essential elements.

In this configuration, as to the metal compound solution as the catalyst to be contacted with the petroleum product or petroleum semimanufactured product in the catalyst liquid-liquid contacting part in the element <A>, the metal compound can be at least one selected from the group consisting of hydrophilic one and lipophilic one, and it can be provided as a solution of at least one selected from the group consisting of water and an organic solvent. The metal compound may be either an inorganic compound or an organic compound. In the case of using an organic solvent, it is preferable that a water compatible solvent such as alcohols or another solvent with a relatively large polarity is used. In particular, the alcohols such as isopropyl alcohol presented in the example later described are preferable. The metal element comprising the metal compound is preferably one having the sulfur compound decomposed by the high-energy beam irradiation, and easily producing metal sulfide by the reaction with the sulfur (S) in the easily reactive state. Preferable examples of the elements comprising the metal compound include silver (Ag), lead (Pb), iron (Fe), copper (Cu), and precious metal.

Use of the above-mentioned metal compound and contacting the same with oil in the above-mentioned catalyst liquid-liquid contacting part are the extremely important characteristics and the essential embodiments of the present invention.

In the above-mentioned known desulfurization method using powder of the metal itself, it is extremely difficult to disperse the metal powder well to the petroleum product or petroleum semimanufactured product so that inconveniences of the aggregation and accumulation of the powder itself cannot be avoided. Therefore, even if the S content is activated by the radioactive ray irradiation, the reaction area of the activated S content and the metal powder is extremely limited.

In contrast, according to the present invention, since a solution of the metal compound as the catalyst is used, and the liquid-liquid contact is executed with the petroleum product or petroleum semimanufactured product, the reaction area can be extremely large so that the desulfurization can be carried out with a highly efficient metal compound production. Besides, the depth desulfurization, which has conventionally been difficult, can be enabled.

Next, as to the high-energy beam irradiating part as the element <B> of the present invention, for example, an X ray source, a radioactive ray source, a γ ray source, a synchrotron, a microwave source, or the like, is provided so that a high-energy beam corresponding thereto can be irradiated.

Thereby, the contained sulfur compound is decomposed by irradiating a strong ionizing radiation such as an X ray and a synchrotron, and reacting the sulfur content with for example, a metal compound solution as the catalyst so as to be substituted to metal sulfide for sedimentation.

In the sulfur compound contained in the petroleum product or semimanufactured product, compounds such as mercaptan, sulfide, and thiophene exist. Among these, as a substance to be hardly desulfurized, 4,6-dialkyl dibenzothiophene can be presented. Since the S of the thiophene part can be dissociated relatively easily by irradiating a strong high-energy beam to the sulfur compound, the S dissociated utilizing the phenomenon is reacted with a catalyst. The reacted S produces a novel S compound (metal sulfide) as a precipitation substance. By separating the oil and the S compound, desulfurization can be carried out. In order to control the desulfurization performance of the sulfur, the decomposition degree of the S in the S compound can be adjusted by increasing or reducing the dosage of the high-energy beam source. Moreover, the desulfurization degree of the sulfur can be controlled also by adjusting the irradiation time of the radioactive ray to the oil. Moreover, it is possible to execute the depth desulfurization further effectively by providing the desulfurization part by the irradiation of a high-energy beam such as a radioactive ray as a plurality of double or triple serial processes.

Here, in the case of executing the desulfurization utilizing for example, an X ray source, by using the X ray source at the time of executing the desulfurization with the X ray of the sulfur absorption end wavelength (5.0185 Å) in a single color, the excellent desulfurization effect can be provided. In the case a single color cannot be provided, it is preferable to utilize the sulfur absorption end wavelength as much as possible. Moreover, in the case the liquid catalyst to be used for the desulfurization is a solution of, for example, silver nitrate, if an X ray source whose wavelength is shorter than the silver absorption end wavelength (3.5 Å) (higher energy) is used as the X ray source to be used for the desulfurization, the silver nitrate is decomposed before the sulfur decomposition so as to be silver oxide or silver so that the desulfurization is prevented (phenomenon of not producing silver sulfide). Therefore, it is important to utilize the absorption end wavelength of the sulfur by cutting the absorption end wavelength of the silver. In addition, in the case of utilizing as a catalyst a metal compound other than silver, the desulfurization can be carried out efficiently by avoiding the absorption end wavelength of the catalyst metal.

As to the liquid catalyst used here, by utilizing a mixture of a hydrophilic catalyst and a lipophilic catalyst (organic metal), the desulfurization effect can be improved. As the reason therefor, since a water soluble substance and a lipophilic substance exist as the sulfur compound contained in the oil, in order to use a catalyst capable of coping flexibly therewith (in order to effectively providing the contact efficiency of the sulfur compound and the catalyst), it is important to use a catalyst mixture.

The sulfur content decomposed by the high-energy beam irradiation reacts with the metal so as to be precipitated in the oil in a fine powdery state. Therefore, in order to efficiently executing the irradiation from the X ray source, or the like, it is preferable to provide an agitator for preventing precipitation or segregation.

Furthermore, as to the irradiation of the radioactive ray, or the like, the irradiation from above or sideways is more preferable than the irradiation from below with respect to the flow of the oil contacted and mixed with the catalyst solution in terms of the desulfurization efficiency. As the reason therefor, in the case of the irradiation from below, the produced metal sulfide may be precipitated so as to cover the window of a specimen irradiation partition wall so that the phenomenon of attenuating the irradiation line amount may be generated. Therefore, since a sufficient desulfurization effect cannot be obtained by the irradiation from below and the irradiation line amount is attenuated with more sedimentation product production, the irradiation from sideways or above is preferable.

It is also effective to carry out a secondary reaction by irradiating a high-energy beam such as an X ray-source to the oil once desulfurized accordingly. The reaction here is not aimed at desulfurization but it is for preventing the catalyst from remaining in the processed petroleum product or petroleum semimanufactured product by precipitating and eliminating the excessive liquid catalyst unnecessary for the desulfurization as oxide or metal.

Furthermore, the sulfide collecting part as the element <C> of the present invention is for separating and collecting the metal sulfide produced by the high-energy beam irradiation from the oil.

Here, the sulfur compound is eliminated so as to achieve desulfurization or refinement by for example filtrating the metal sulfide produced in the irradiation part of the radioactive ray, or the like using a filtrating film.

As to the filter, in order to enable continuous use, it is possible to use a plurality of filters for eliminating the metal sulfide while regularly switching the line of the oil flow. Moreover, it is also possible to adopt a method of continuous separation utilizing the centrifugal separation or the cyclone principal.

Moreover, in the case the process amount is small and desulfurization is not executed continuously, it is also possible to separate the oil and the metal sulfide by storing the same in a certain container and executing still standing separation.

By using these elimination methods in a combination, the desulfurization can be achieved by eliminating the produced metal sulfide utilizing a processing method according to the processing ability therein.

In the present invention as mentioned above, a catalyst reproducing part, a catalyst circulation path, a sulfuric acid producing part, or a solvent reproducing part can further be provided optionally.

As the compound to be used as the catalyst, a substance easily reactive with the sulfur and capable of producing a precipitated substance by bonding, such as silver nitrate, lead nitrate, silver oxide, and lead oxide can be selected.

As in the case of silver nitrate as a representative example, the silver nitrate produces silver sulfide relatively easily by contact with the sulfur decomposed by the high-energy beam irradiation. The silver sulfide can be taken out as the silver sulfide from the oil by filtration.

Here, in the catalyst reproducing part, the separated silver sulfide is first combusted (oxidized) so as to be substituted to silver oxide. After taking the silver oxide form, by a reduction reaction using aldehyde, it is substituted again to silver. Then, by contacting the silver with nitric acid, it is reproduced as the silver nitrate so as to be reused as a raw material of the catalyst.

After production of the silver nitrate, in order to reuse as the catalyst, a diluting solvent such as isopropyl alcohol is introduced for executing the concentration adjustment for effectively performing as the catalyst. After executing the adjustment, it is introduced again to material oil so that it can be reused as a feed.

At the time, since $SO_x$ is generated simultaneously with the combustion (oxidation) reaction, the generated gas is guided to a process for scavenging the same.

Moreover, since the aldehyde is changed to carboxylic acids as a by-product, it is scavenged in the form.

By collecting the $SO_x$ generated in the catalyst reproducing part by water and hydrogen peroxide water in the sulfuric acid producing part, it can be taken out as dilute sulfuric acid. By heating and condensing the dilute sulfuric acid solution so as to be changed to concentrated sulfuric acid, it can be used as a sulfuric acid product.

As to the change from the $SO_2$ to the sulfuric acid, it is necessary to substitute to the sulfuric acid after adding an oxidation reaction process for changing into an $SO_3$ form.

In the case of using an organic solvent such as isopropyl alcohol (representative example) for adjusting the catalyst concentration, since it exists in the petroleum product, it is necessary to separate the same from the desulfurized product by a distillation step.

In the distillation step, by distillating at the boiling temperature (80° C.) of isopropyl alcohol, the isopropyl alcohol is taken out from the upper part of a distillation tower. Since the taken out isopropyl alcohol is in a gaseous state, it is cooled down through a heat exchanger so as to be changed to liquefied isopropyl alcohol.

The liquefied isopropyl alcohol is sent to a catalyst reproducing tower so as to be mixed with for example silver nitrate so that it can be reused for the desulfurization reaction as a liquid catalyst.

Hereinafter, test examples and device configuration examples will be described for explaining the present invention in further detail.

TEST EXAMPLE 1

(Desulfurization Effect of a Liquid Catalyst and a Solid Catalyst)

The desulfurization effect of a liquid catalyst and a solid catalyst was evaluated using a specimen with a 50 ppm sulfur concentration.

(1) Experiment

As experiment specimens, two petroleum samples, each having a 50 ppm sulfur concentration, were prepared in beakers, one with a liquid catalyst (silver nitrate solution catalyst) added and the other with a solid catalyst (powdered silver) added.

As to the X ray irradiation condition, an Rh tube was used in a 20 kV–70 mA condition with the silver absorption end wavelength cut. As to the irradiation time, irradiation was carried out each for 0, 15, 30, 45, 60 minutes. In order to observe the desulfurization effect, the experiment specimens were filtrated for eliminating the reaction product with the catalyst (including the solid catalyst). The reduction ratio of the sulfur intensity in the filtrated liquid was measured as the S-Kα strength for the desulfurization effect.

The irradiation was carried out from above.

(2) Results

Change of the solid catalyst and the desulfurization effect of the liquid catalyst are shown in the table 1 and FIG. 1.

Although the desulfurization effect appears remarkably for the liquid catalyst, the desulfurization effect cannot be observed at all for the solid catalyst.

From the experiment result mentioned above, it is considered that the desulfurization effect can be shown remarkably for the liquid catalyst owing to the excellent contact efficiency with the sulfur. In contrast, in the case of the solid catalyst, it is considered that the desulfurization effect was not observed because the contact efficiency with the sulfur is extremely poor due to absence of the flowability.

TABLE 1

Desulfurization effect comparison for the liquid catalyst and the solid catalyst

| | Liquid catalyst | | Solid catalyst | |
|---|---|---|---|---|
| Irradiation time (minute) | Actual measurement strength | Relative strength | Actual measurement strength | Relative strength |
| 0 | 2.1376 | 1 | 1.9506 | 1 |
| 15 | 2.31875 | 1.08 | 2.2645 | 1.16 |
| 30 | 1.7951 | 0.84 | 2.3164 | 1.19 |
| 45 | 1.6687 | 0.78 | 2.3232 | 1.19 |
| 60 | 1.6201 | 0.76 | 2.3586 | 1.21 |

TEST EXAMPLE 2

Desulfurization Effect of the Irradiation from Above and the Irradiation from Below)

The desulfurization effect of the irradiation from above and the irradiation from below was evaluated using a specimen with a 50 ppm sulfur concentration.

(1) Experiment

As experiment specimen, a petroleum specimen with a 50 ppm sulfur concentration was prepared in a beaker with a liquid catalyst (silver nitrate solution catalyst) added.

As to the X ray irradiation condition, an Rh tube was used in a 20 kV–70 mA condition with the silver absorption end wavelength cut. As to the irradiation time, irradiation was carried out from above or below each for 0, 15, 30, 45, 60 minutes for observing the desulfurization effect. In order to judge the desulfurization effect, the experiment specimens were filtrated for eliminating the reaction product with the catalyst. The reduction ratio of the sulfur intensity in the filtrated liquid was measured as the S-Kα strength for the desulfurization effect.

(2) Results

Figure 2:
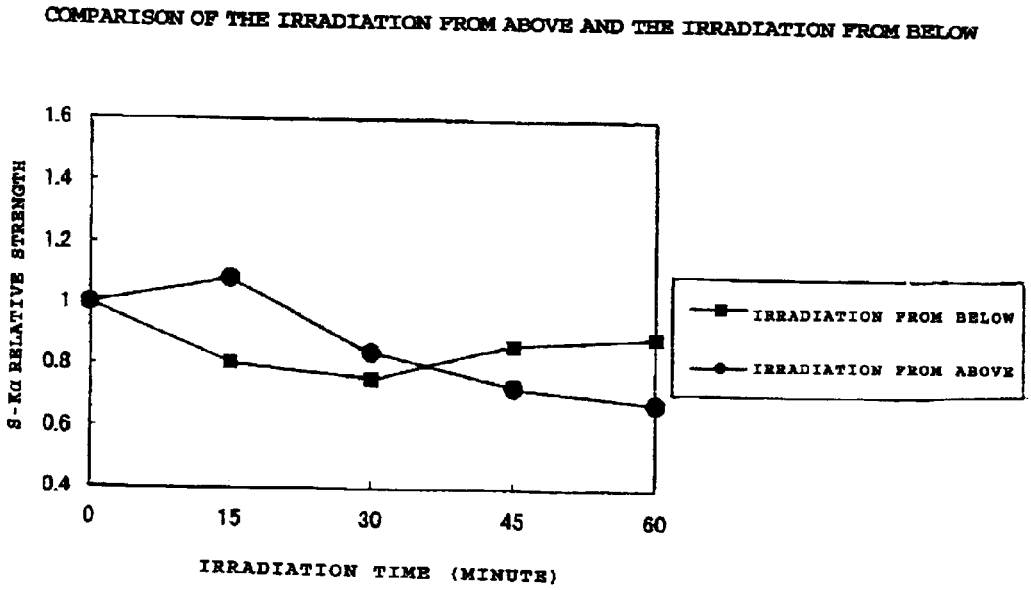
FIG. 2 is a graph showing the result of a test example 2.

The desulfurization effect in the case of the irradiation from above and the irradiation from below are shown in the table 2 and FIG. 2.

In comparison of the desulfurization effects in the case of 60 minutes, it is observed that the desulfurization effect of the irradiation from above is superior. Moreover, in the case of the irradiation from below, an extraordinary change is observed so that the drastic desulfurization effect cannot be expected.

From the above-mentioned results, in the case of the irradiation from above, the desulfurization effect can be increased by the long time irradiation so that the correlation of the irradiation time and the desulfurization effect can be obtained.

However, in the case of the desulfurization from below, although the excellent desulfurization effect is provided in the irradiation initial stage, the desulfurization cannot be provided further after 30 minutes. This is considered that the substance precipitated as the silver sulfide prevents the X ray irradiation. An extraordinary behavior is observed from the point after 30 minutes. This is considered that due to the excessive irradiation of the X ray to the substance precipitated as the silver sulfide and the silver sulfide is decomposed again so as to generate a phenomenon of separation to silver and sulfur so that a phenomenon of returning the decomposed sulfur to the oil is generated.

TABLE 2

Desulfurization effect comparison for the irradiation from above and the irradiation from below

| | Irradiation from below | | Irradiation from above | |
|---|---|---|---|---|
| Irradiation time (minute) | Actual measurement strength | Relative strength | Actual measurement strength | Relative strength |
| 0 | 1.9962 | 1 | 2.1376 | 1 |
| 15 | 1.6066 | 0.8 | 2.3188 | 1.08 |
| 30 | 1.5032 | 0.75 | 1.7951 | 0.84 |
| 45 | 1.7247 | 0.86 | 1.6687 | 0.73 |
| 60 | 1.7841 | 0.89 | 1.6201 | 0.68 |

Device Configuration Example

Figure 3:
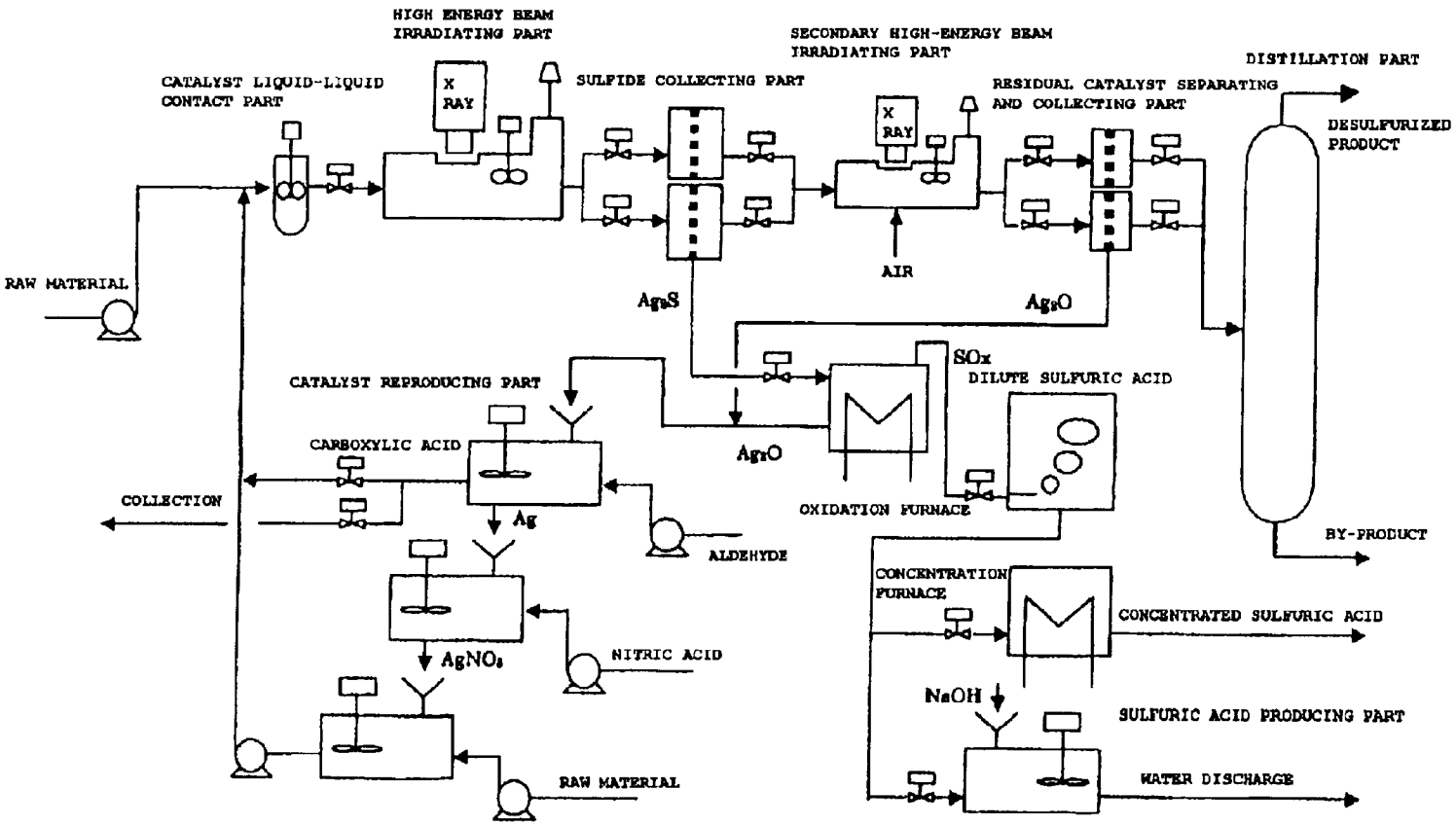
FIG. 3 is an entire configuration chart of a desulfurization device according to an embodiment of the present invention.

The drawing of FIG. 3 attached hereto shows an example of the configuration of the present invention. Of course the present invention is not limited by the example of FIG. 3.

In this example, as the catalyst, silver nitrate ($AgNO_3$) dissolved in a solvent mixture of water and isopropyl alcohol as mentioned above is used. As to the amount ratio of the water and the isopropyl alcohol, it is adjusted in a range of for example 1:100 to 100:1, more preferably 1:50 to 50:1. The solution concentration or the amount of the silver nitrate, that is, the amount with respect to the petroleum product or petroleum semimanufactured product as the material in FIG. 3 can be determined according to the amount of sulfur compound contained therein.

In FIG. 3, the solution of the silver nitrate as the catalyst is liquid-liquid contacted with the above-mentioned material, then the X ray or the like is irradiated from above or sideways in the high-energy beam irradiating part. The silver sulfide produced by the X ray irradiation is separated and collected in the sulfide collecting part so that it is reproduced as the catalyst of the silver nitrate solution in the catalyst reproducing part as well as the S content is converted to the concentrated sulfuric acid in the sulfuric acid producing part.

Moreover, in the example of FIG. 3, a secondary high-energy beam irradiating part is provided. Thereby, the X ray or the like is irradiated again from above or sideways. By irradiating a strong high-energy beam such as the X ray or the like to the catalyst remaining in the oil, the catalyst is changed to Ag, $Ag_2O$, or the like so as to be collected.

As heretofore explained in detail, according to the desulfurization device of the present invention for irradiating a high-energy beam in the presence of a liquid catalyst and a desulfurization refining device for a petroleum product or a petroleum semimanufactured product comprising the same as the essential part, an efficient and highly practical novel desulfurization device capable of achieving the depth desulfurization, which has been at issue recently, can be provided.

What is claimed is:

1. A high-energy beam irradiating desulfurization device for a petroleum product or a petroleum semimanufactured product, comprising a catalyst liquid-liquid contact part for contacting a metal compound solution as a catalyst and the petroleum product or the petroleum semimanufactured product, a high-energy beam irradiating part, and a sulfide collecting part for separating and collecting sulfide of the metal produced by the high-energy beam irradiation.

2. The high-energy beam irradiating desulfurization device according to claim 1, wherein the metal compound is at least one selected from the group consisting of a hydrophilic compound and a lipophilic compound.

3. The high-energy beam irradiating desulfurization device according to claim 2, wherein the metal compound solution is a solution of at least one selected from the group consisting of water and an organic solvent.

4. The high-energy beam irradiating desulfurization device according to claim 2, wherein the metal comprising the metal compound is at least one selected from the group consisting of silver, lead, iron, copper, and precious metal.

5. The high-energy beam irradiating desulfurization device according to claim 2, wherein the high-energy beam irradiating part is provided with at least one selected from the group consisting of an X ray source, a radioactive ray source, a synchrotron, and a microwave source.

6. The high-energy beam irradiating desulfurization device according to claim 2, wherein the high-energy beam is directed to a liquid mixture from the catalyst liquid-liquid contacting part at least either from above or sideways in the high-energy beam irradiating part.

7. The high-energy beam irradiating desulfurization device according to claim 2, wherein the sulfide collecting part is provided with at least one selected from the group consisting of a filter, a static amount separator, a centrifugal separating device, and a cyclone separating device.

8. The high-energy beam irradiating desulfurization device according to claim 2, wherein a secondary high-energy beam irradiating part is provided for secondarily irradiating a high-energy beam from at least either above or sideways subsequent to the sulfide collecting part.

9. The high-energy beam irradiating desulfurization device according to claim 2, wherein a catalyst reproducing part is provided for reproducing the catalyst from the sulfide of the metal collected in the sulfide collecting part.

10. The high-energy beam irradiating desulfurization device according to claim 2, wherein a sulfuric acid producing part is provided for producing sulfuric acid from the sulfide of the metal collected in the sulfide collecting part.

11. The high-energy beam irradiating desulfurization device according to claim 2, wherein a distillation part is provided for separating the desulfurized petroleum product or petroleum semimanufactured product and the catalyst solvent.

12. A petroleum refining device comprising the desulfurization device according to claim 2 assembled as a part of the petroleum refining device.

13. The high-energy beam irradiating desulfurization device according to claim 1, wherein the metal compound solution is a solution of at least one selected from the group consisting of water and an organic solvent.

14. The high-energy beam irradiating desulfurization device according to claim 13, wherein the metal comprising the metal compound is at least one selected from the group consisting of silver, lead, iron, copper, and precious metal.

15. The high-energy beam irradiating desulfurization device according to claim 13, wherein the high-energy beam irradiating part is provided with at least one selected from the group consisting of an X ray source, a radioactive ray source, a synchrotron, and a microwave source.

16. The high-energy beam irradiating desulfurization device according to claim 13, wherein the high-energy beam is directed to a liquid mixture from the catalyst liquid-liquid contacting part at least either from above or sideways in the high-energy beam irradiating part.

17. The high-energy beam irradiating desulfurization device according to claim 13, wherein the sulfide collecting part is provided with at least one selected from the group consisting of a filter, a static amount separator, a centrifugal separating device, and a cyclone separating device.

18. The high-energy beam irradiating desulfurization device according to claim 13, wherein a secondary high-energy beam irradiating part is provided for secondarily irradiating a high-energy beam from at least either above or sideways subsequent to the sulfide collecting part.

19. The high-energy beam irradiating desulfurization device according to claim 13, wherein a catalyst reproducing part is provided for reproducing the catalyst from the sulfide of the metal collected in the sulfide collecting part.

20. The high-energy beam irradiating desulfurization device according to claim 13, wherein a sulfuric acid producing part is provided for producing sulfuric acid from the sulfide of the metal collected in the sulfide collecting part.

21. The high-energy beam irradiating desulfurization device according to claim 13, wherein a distillation part is provided for separating the desulfurized petroleum product or petroleum semimanufactured product and the catalyst solvent.

22. A petroleum refining device comprising the desulfurization device according to claim 13 assembled as a part of the petroleum refining device.

23. The high-energy beam irradiating desulfurization device according to claim 1, wherein the metal comprising the metal compound is at least one selected from the group consisting of silver, lead, iron, copper, and precious metal.

24. The high-energy beam irradiating desulfurization device according to claim 23, wherein the high-energy beam irradiating part is provided with at least one selected from the group consisting of an X ray source, a radioactive ray source, a synchrotron, and a microwave source.

25. The high-energy beam irradiating desulfurization device according to claim 23, wherein the high-energy beam is directed to a liquid mixture from the catalyst liquid-liquid contacting part at least either from above or sideways in the high-energy beam irradiating part.

26. The high-energy beam irradiating desulfurization device according to claim 23, wherein the sulfide collecting part is provided with at least one selected from the group consisting of a filter, a static amount separator, a centrifugal separating device, and a cyclone separating device.

27. The high-energy beam irradiating desulfurization device according to claim 23, wherein a secondary high-energy beam irradiating part is provided for secondarily irradiating a high-energy beam from at least either above or sideways subsequent to the sulfide collecting part.

28. The high-energy beam irradiating desulfurization device according to claim 23, wherein a catalyst reproducing part is provided for reproducing the catalyst from the sulfide of the metal collected in the sulfide collecting part.

29. The high-energy beam irradiating desulfurization device according to claim 23, wherein a sulfuric acid producing part is provided for producing sulfuric acid from the sulfide of the metal collected in the sulfide collecting part.

30. The high-energy beam irradiating desulfurization device according to claim 23, wherein a distillation part is provided for separating the desulfurized petroleum product or petroleum semimanufactured product and the catalyst solvent.

31. A petroleum refining device comprising the desulfurization device according to claim 23 assembled as a part of the petroleum refining device.

32. The high-energy beam irradiating desulfurization device according to claim 1, wherein the high-energy beam irradiating part is provided with at least one selected from the group consisting of an X ray source, a radioactive ray source, a synchrotron, and a microwave source.

33. The high-energy beam irradiating desulfurization device according to claim 32, wherein the high-energy beam is directed to a liquid mixture from the catalyst liquid-liquid contacting part at least either from above or sideways in the high-energy beam irradiating part.

34. The high-energy beam irradiating desulfurization device according to claim 32, wherein the sulfide collecting part is provided with at least one selected from the group consisting of a filter, a static amount separator, a centrifugal separating device, and a cyclone separating device.

35. The high-energy beam irradiating desulfurization device according to claim 32, wherein a secondary high-energy beam irradiating part is provided for secondarily irradiating a high-energy beam from at least either above or sideways subsequent to the sulfide collecting part.

36. The high-energy beam irradiating desulfurization device according to claim 32, wherein a catalyst reproducing part is provided for reproducing the catalyst from the sulfide of the metal collected in the sulfide collecting part.

37. The high-energy beam irradiating desulfurization device according to claim 32, wherein a sulfuric acid producing part is provided for producing sulfuric acid from the sulfide of the metal collected in the sulfide collecting part.

38. The high-energy beam irradiating desulfurization device according to claim 32, wherein a distillation part is provided for separating the desulfurized petroleum product or petroleum semimanufactured product and the catalyst solvent.

39. A petroleum refining device comprising the desulfurization device according to claim 32 assembled as a part of the petroleum refining device.

40. The high-energy beam irradiating desulfurization device according to claim 1, wherein the high-energy beam is directed to a liquid mixture from the catalyst liquid-liquid contacting part at least either from above or sideways in the high-energy beam irradiating part.

41. The high-energy beam irradiating desulfurization device according to claim 40, wherein the sulfide collecting part is provided with at least one selected from the group consisting of a filter, a static amount separator, a centrifugal separating device, and a cyclone separating device.

42. The high-energy beam irradiating desulfurization device according to claim 40, wherein a secondary high-energy beam irradiating part is provided for secondarily irradiating a high-energy beam from at least either above or sideways subsequent to the sulfide collecting part.

43. The high-energy beam irradiating desulfurization device according to claim 40, wherein a catalyst reproducing part is provided for reproducing the catalyst from the sulfide of the metal collected in the sulfide collecting part.

44. The high-energy beam irradiating desulfurization device according to claim 40, wherein a sulfuric acid producing part is provided for producing sulfuric acid from the sulfide of the metal collected in the sulfide collecting part.

45. The high-energy beam irradiating desulfurization device according to claim 40, wherein a distillation part is provided for separating the desulfurized petroleum product or petroleum semimanufactured product and the catalyst solvent.

46. A petroleum refining device comprising the desulfurization device according to claim 40 assembled as a part of the petroleum refining device.

47. The high-energy beam irradiating desulfurization device according to claim 1, wherein the sulfide collecting part is provided with at least one selected from the group consisting of a filter, a static amount separator, a centrifugal separating device, and a cyclone separating device.

48. The high-energy beam irradiating desulfurization device according to claim 47, wherein a secondary high-energy beam irradiating part is provided for secondarily irradiating a high-energy beam from at least either above or sideways subsequent to the sulfide collecting part.

49. The high-energy beam irradiating desulfurization device according to claim 47, wherein a catalyst reproducing part is provided for reproducing the catalyst from the sulfide of the metal collected in the sulfide collecting part.

50. The high-energy beam irradiating desulfurization device according to claim 47, wherein a sulfuric acid producing part is provided for producing sulfuric acid from the sulfide of the metal collected in the sulfide collecting part.

51. The high-energy beam irradiating desulfurization device according to claim 47, wherein a distillation part is provided for separating the desulfurized petroleum product or petroleum semimanufactured product and the catalyst solvent.

52. A petroleum refining device comprising the desulfurization device according to claim 47 assembled as a part of the petroleum refining device.

53. The high-energy beam irradiating desulfurization device according to claim 1, wherein a secondary high-energy beam irradiating part is provided for secondarily irradiating a high-energy beam from at least either above or sideways subsequent to the sulfide collecting part.

54. The high-energy beam irradiating desulfurization device according to claim 53, wherein a catalyst reproducing part is provided for reproducing the catalyst from the sulfide of the metal collected in the sulfide collecting part.

55. The high-energy beam irradiating desulfurization device according to claim 53, wherein a sulfuric acid producing part is provided for producing sulfuric acid from the sulfide of the metal collected in the sulfide collecting part.

56. The high-energy beam irradiating desulfurization device according to claim 53, wherein a distillation part is provided for separating the desulfurized petroleum product or petroleum semimanufactured product and the catalyst solvent.

57. A petroleum refining device comprising the desulfurization device according to claim 53 assembled as a part of the petroleum refining device.

58. The high-energy beam irradiating desulfurization device according to claim 1, wherein a catalyst reproducing part is provided for reproducing the catalyst from the sulfide of the metal collected in the sulfide collecting part.

59. The high-energy beam irradiating desulfurization device according to claim 58, wherein a circulating path to the catalyst liquid-liquid contacting part is provided for the reproduced catalyst.

60. The high-energy beam irradiating desulfurization device according to claim 59, wherein a distillation part is provided for separating the desulfurized petroleum product or petroleum semimanufactured product and the catalyst solvent.

61. A petroleum refining device comprising the desulfurization device according to claim 59 assembled as a part of the petroleum refining device.

62. The high-energy beam irradiating desulfurization device according to claim 58, wherein a sulfuric acid producing part is provided for producing sulfuric acid from the sulfide of the metal collected in the sulfide collecting part.

63. The high-energy beam irradiating desulfurization device according to claim 58, wherein a distillation part is provided for separating the desulfurized petroleum product or petroleum semimanufactured product and the catalyst solvent.

64. A petroleum refining device comprising the desulfurization device according to claim 58 assembled as a part of the petroleum refining device.

65. The high-energy beam irradiating desulfurization device according to claim 1, wherein a sulfuric acid producing part is provided for producing sulfuric acid from the sulfide of the metal collected in the sulfide collecting part.

66. The high-energy beam irradiating desulfurization device according to claim 65, wherein a distillation part is provided for separating the desulfurized petroleum product or petroleum semimanufactured product and the catalyst solvent.

67. A petroleum refining device comprising the desulfurization device according to claim 65 assembled as a part of the petroleum refining device.

68. The high-energy beam irradiating desulfurization device according to claim 1, wherein a distillation part is provided for separating the desulfurized petroleum product or petroleum semimanufactured product and the catalyst solvent.

69. A petroleum refining device comprising the desulfurization device according to claim 1 assembled as a part of the petroleum refining device.

* * * * *